US008555417B2

(12) United States Patent
Choi

(10) Patent No.: US 8,555,417 B2
(45) Date of Patent: Oct. 15, 2013

(54) SLEEPING CAP

(76) Inventor: Insook Choi, Billerica, MA (US)

( * ) Notice: Subject to any disclaimer, the term of this patent is extended or adjusted under 35 U.S.C. 154(b) by 145 days.

(21) Appl. No.: 13/158,542

(22) Filed: Jun. 13, 2011

(65) Prior Publication Data

US 2011/0231984 A1 Sep. 29, 2011

Related U.S. Application Data

(63) Continuation-in-part of application No. 11/827,152, filed on Jul. 9, 2007, now Pat. No. 8,181,277.

(51) Int. Cl.
*A41B 1/04* (2006.01)

(52) U.S. Cl.
USPC ..... 2/172; 132/274; 2/410; 2/209

(58) Field of Classification Search
USPC ..... 2/171, 174, 171.2, 202, 421, 410; 5/636; 132/274, 212
See application file for complete search history.

(56) References Cited

U.S. PATENT DOCUMENTS

| | | | | | |
|---|---|---|---|---|---|
| 2,044,521 | A * | 6/1936 | Weiland et al. | 132/274 |
| 2,255,708 | A * | 9/1941 | Laughton | 132/274 |
| 2,367,459 | A * | 1/1945 | Corley | 2/209 |
| 2,508,631 | A * | 5/1950 | Woodside | 132/274 |
| 2,533,526 | A * | 12/1950 | Snyder | 606/204.35 |
| 2,546,842 | A * | 3/1951 | Yealdhall | 2/425 |
| 2,665,427 | A * | 1/1954 | Street et al. | 2/195.7 |
| 2,671,446 | A * | 3/1954 | Mann | 606/204.35 |
| 2,696,007 | A * | 12/1954 | Larkin et al. | 2/171 |
| 2,698,944 | A * | 1/1955 | Ramsby | 2/174 |
| 2,983,925 | A * | 5/1961 | Gettinger | 2/204 |
| 2,996,724 | A * | 8/1961 | Rose et al. | 2/171 |
| 3,213,466 | A * | 10/1965 | Gettinger | 2/171.01 |
| 3,561,455 | A * | 2/1971 | Gregg | 132/274 |
| 3,613,118 | A * | 10/1971 | Lucas | 2/209.7 |
| 5,920,909 | A * | 7/1999 | Ellsworth et al. | 2/171 |
| 6,189,151 | B1 * | 2/2001 | Curtis | 2/171 |
| 6,735,783 | B2 * | 5/2004 | Phillips | 2/202 |
| 7,225,811 | B2 * | 6/2007 | Ruiz et al. | 128/207.11 |
| 7,428,763 | B2 * | 9/2008 | Hightower | 5/636 |
| 2006/0082205 | A1 * | 4/2006 | Hobson | 297/393 |
| 2006/0090247 | A1 * | 5/2006 | Cho | 2/209.3 |
| 2008/0189863 | A1 * | 8/2008 | Zappas | 5/636 |

* cited by examiner

*Primary Examiner* — Richale Quinn
(74) *Attorney, Agent, or Firm* — John H. Pearson, Jr., Esq.; Walter F. Dawson, Esq.; Pearson & Pearson LLP.

(57) ABSTRACT

A sleeping cap for lifting the face of a person away from a sleeping surface to prevent facial wrinkles comprises a U-shaped basic form covered with a fabric and having first and second extensions, each of the extensions being flexibly positioned within the fabric adjacent to each leg end of the U-shaped basic form, and the fabric covering the end of first extension is attached to the fabric at the end of the second extension to form the sleeping cap. Straps from each side of the sleeping cap secure the cap on the person's head. An alternate embodiment provides an elastic encased in the sleeping cap not having straps, and including a one piece foam rubber basic form enclosed within two stitched pieces of fabric, a lace ring with a ribbon at the top edge of the lace ring, and the lace ring is tacked to a portion of the basic form, to form a gathered top of the sleeping cap.

10 Claims, 9 Drawing Sheets

FIG. 2A
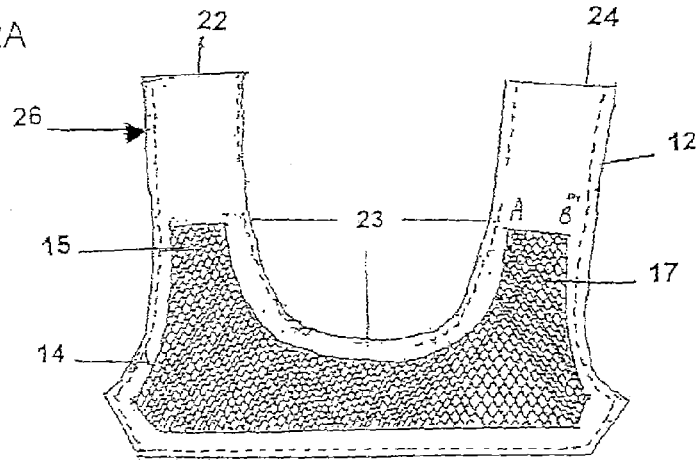
FIG. 2B
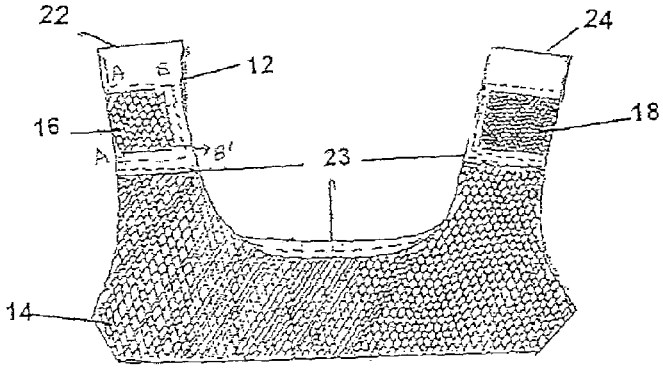
FIG. 2D
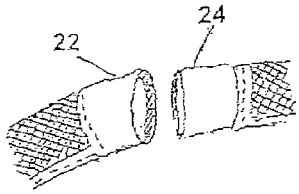
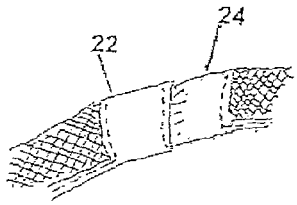
FIG. 2E

SLEEPING CAP

This application is a Continuation-In-Part of prior application Ser. No. 11/827,152, filed Jul. 9, 2007, now pending which is herein incorporated by reference.

BACKGROUND OF THE INVENTION

1. Field of the Invention

This invention relates generally to sleeping caps and in particular to a sleeping cap that lifts the face of a person away from the surface of a pillow to prevent the forming of facial wrinkles.

2. Description of Related Art

It is known that some people struggle to sleep on their backs and not on their sides because sleeping on the side creates wrinkles on the face. It is desirable to have a product which will lift a side of the face of a person away from the surface of the pillow while the person is sleeping on the side.

Back in the early 1960s, it is believed that the Shakers slept on their backs, and perhaps they were experimenting with this theory. On the worldwide web, there are pillows that claim to aid in anti-wrinkling. Therefore, many people seem to agree that there is a relationship between sleeping positions and wrinkles on the face. If you lie on your side and then look at your face in the mirror, you may agree with this theory.

U.S. Pat. No. 2,044,521 issued Jun. 16, 1936 to H. M. Weiland at al. discloses a combination chin strap and hair cap device. The hair cap helps the hair or wave set of a person in place and the elastic chin strap supports drooping and sagging muscles or tissues and will further effectively reduce double chins and eliminate tell-tale lines on a face. The device comprises a hair cap of open work fabrics including a crown portion and side pieces, and the chin strap is connected to the lower ends of the side pieces; however, the device does not lift the side of a person's face away from a pillow or bed sheet to prevent creating wrinkles on the face. There is only a netlike or open work fabric between the face and the pillow surface and it appears that the tightness of the net and the jaw strap pushes the cheek towards the nose and will cause the face to have wrinkles.

U.S. Pat. No. 2,696,007 issued Dec. 7, 1954 to F. R. Larkin et al. discloses a sleeping halo or cap secured to a head of a wearer comprising a resilient halo-shaped bun or annulus adapted to be secured substantially at the base of the skull cap of the wearer to prevent rolling of the head during sleep. The annulus is held in place preferably by means of suitable chin strings. However, this device provides no support of the neck to enable the wearer to sleep in comfort and uses narrow ties which are tied under the wearer's chin and are a source of discomfort by becoming too tight or choking the wearer.

U.S. Pat. No. 7,428,763 B2 issued Sep. 30, 2008 to Anthony Hightower discloses a multipurpose pillow used for beauty or health purposes. When used in combination with a support surface, the pillow eliminates any contact between the support surface or the pillow and the delicate sensitive surface of the facial skin. The pillow comprises a unitary member having a first end section and a second end section adjustably interconnected by an adjustment means, for example, interconnected across the forehead of a user. However, the pillow is bulky and the adjustment means or band alone across the forehead will not maintain the pillow around the head. The band may cause disturbance on the skin and cause wrinkles to appear on the forehead and around the upper eyes. The pillow needs another fastening on the lower front part of the product to cover the ears in order to lift the face from the bed to prevent wrinkling. Also, the pillow is not secure against sleeping body movement.

Dermatologists assert that our facial expression causes the formation of wrinkles on a person's face. If a mere expression affects the face, surely when the heavy weight of the head is on the side of the face which is pressed against a pillow, it causes wrinkles to form and remain there when a person reaches a certain age. The wrinkles formed by the expression such as two vertical lines between the eyebrows also deepen when we sleep on our side.

Yet, it seems that people are not quite satisfied with the wrinkle resisting pillows available in the marketplace today. Therefore, the present invention is believed to solve this problem.

SUMMARY OF THE INVENTION

Accordingly, it is therefore an object of this invention to provide a sleeping cap that lifts a person's face from any surface while the person sleeps on either side.

It is an object of this invention to provide a sleeping cap in the form of a ring for stability and comfort of the wearer especially at the neck area.

It is another object of this invention to provide a cushion-like material in the basic form of the sleeping cap for comfort of the wearer.

It is yet another object of this invention to provide an elastic encased sleeping cap embodiment having a one piece basic form and no straps.

These and other objects are further accomplished by a sleeping cap comprising a generally U-shaped basic form having a first column and a second column extending from a lower portion having side edges extended outward, a fabric formed to cover the U-shaped basic form, the U-shaped basic form inserted within the fabric, wherein a first end of the fabric covers a first column of the basic form and a second end of the fabric covers a second column of the basic form, the first end of the fabric is inserted within an opening of the second end of the fabric and attached thereto, a soft, light weight material having two ends sewn together forming a ring shape of the material, an elastic enclosed within a lower perimeter channel of the ring shaped material, the elastic having two ends attached together, a bias tape is attached to an upper edge of the ring shaped material overlapping each side, a ribbon inserted into a casing formed by the bias tape and the ends of the ribbon when pulled together form the soft, light weight material into a gathered top portion of the sleeping cap, and a plurality of points around a lower perimeter of the soft, light weight ring-shaped material are attached to the fabric around the edges of the U-shaped basic form forming the sleeping cap. The U-shaped basic form comprises a cushion-like material including foam rubber. The fabric comprises one of a group including a wrinkle free cotton blend, rayon, satin and other fancy fabric. The soft, light weight material comprises one of a group including lace, fine tulle and other soft and wrinkle free fabric. The ring shaped material comprises a ribbon around the circumference of the material and attached a predetermined distance from an edge of the ring shaped material.

The objects are further accomplished by a method of making a sleeping cap comprising the steps of providing a generally U-shaped basic form having a first column and a second column extending from a lower portion having side edges extended outward, forming a fabric to cover the U-shaped basic form, inserting the U-shaped basic form within the fabric, wherein a first end of the fabric covers a first column of the basic form and a second end of the fabric covers a second column of the basic form, inserting the first end of the fabric above the first column within an opening of the second end of the fabric above the second column and attaching the first end and the second end together, forming a ring shape from a rectangular, soft, light weight material by sewing two narrow ends together, enclosing an elastic within a lower perimeter channel of the ring shaped material, the elastic having two ends attached together, attaching a bias tape to an upper edge of the ring shaped material overlapped on each side, inserting a ribbon into a casing formed by the bias tape, pulling and tying the ends of the ribbon together to form the soft, light weight material into a gathered top portion of the sleeping cap, attaching a plurality of points around a lower perimeter of the soft, light weight ring-shaped material to the fabric around the edges of the U-shaped basic form forming the sleeping cap. The step of providing a generally U-shaped basic form comprises the step of providing a cushion-like material including foam rubber. The step of forming a fabric to cover the U-shaped basic form comprises the step of providing a fabric from one of a group including a wrinkle free cotton blend, rayon, satin and other fancy fabric. The step of forming a ring shape of a rectangular, soft, light weight material comprises the step of providing the material from one of a group including lace, fine tulle and other soft and wrinkle free fabric. The method comprises the step of providing a ribbon around the circumference of the ring shaped material attached a predetermined distance from an edge of the ring shaped material.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIG. 2A shows the basic form of FIG. 1A positioned within layers of fabric for forming a sleeping cap having the outer fabric cut away to show the basic form;

FIG. 2B shows the outer fabric of FIG. 2A removed and the addition of the foam rubber pieces inserted as upper extensions of the basic form of the sleeping cap;

FIG. 2D is a perspective view of the legs of the outer fabric covering the basic form positioned to be connected together;

FIG. 2E shows the legs of the outer fabric of FIG. 2D connected together;

DESCRIPTION OF ILLUSTRATIVE EMBODIMENT

Figure 3A:
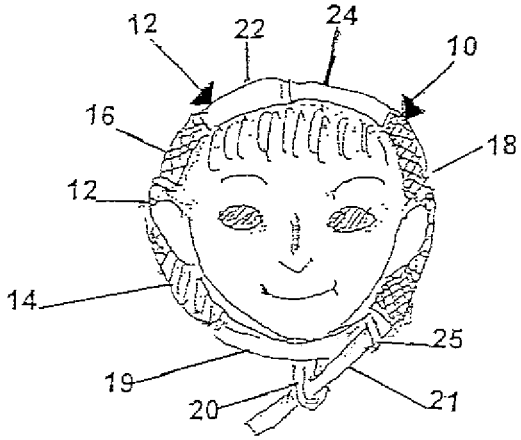
FIG. 3A is a front view of a sleeping cap positioned on a person's head with a portion of the outer fabric cut-away to show the basic form and extensions.
Figure 3B:
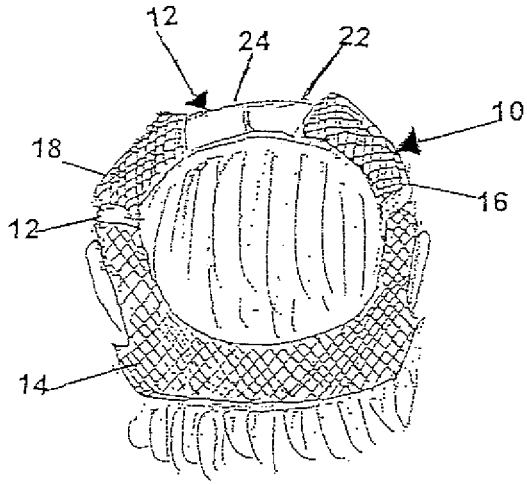
FIG. 3B is a rear view of a sleeping cap positioned on a person's head with a portion of the outer fabric cut-away to show the basic form and extensions.

Referring to the drawings and in particular FIGS. 3A and 3B, FIG. 3A is a front view of a sleeping cap 10 on a person's head with a portion of the outer fabric 12 removed to show the basic form 14, a first extension 16, and a second extension 18. Straps 20, 21 made from a fabric material, provide for securing the sleeping cap 10 to the person's head. FIG. 3B is a rear view of a sleeping cap positioned on the person's head with a portion of the outer fabric 12 cut-away to show the U-shaped basic form 14 along with the extensions 16, 18. The sleeping cap 10 lifts the face of the person away from a sleeping surface to prevent the face from being pressed against the sleeping surface such as a pillow and to prevent facial wrinkles.

The basic form 14 is used in making the sleeping cap 10, and it is approximately U-shaped with lower sides extended sideways. It is referred to as "basic form" because it may be used to make various embodiments of sleeping caps, and the various embodiments are referred to as "RYALL CAPS" (pronounced the same as the word "real") which is an acronym for Retaining Youthful And Lovely Look. When a fabric or cloth 26 is used to cover the basic form 14 by sewing, two rectangular pieces or extensions 16, 18 are added on top of the legs 15, 17 of the U-shaped basic form 14. Once the two rectangular extensions 16, 18 are added, the ends 22, 24 (FIG. 2A) of the fabric or cloth 26 are joined together by sewing, and the sleeping cap 10 looks like a ring. The basic form 14 and the extensions 16, 18 may be embodied by foam rubber or other similar cushion-like, resilient materials known in the art.

Still referring to FIGS. 2A and 3B, the ring of the sleeping cap 10 is designed so that the two legs 15, 17 of the U-shape basic form 14 will stay tucked in the back of the ears and the two small or rectangular extensions 16, 18 start above the ear extending to part of the forehead. The bottom portion of the U-shape basic form 14 rests on the back of the neck and extends to the start of a jaw line of the wearer. When the sleeping cap 10 is made with the basic form 14, it may be attached securely to the head with combs, bobby pins, chin straps or eye-masks. The combs or bobby pins may be attached to the fabric covering the extensions 16, 18. Thus, the sleeping cap 10 withstands the toss and turns of the head, and a person's face will be prevented from pressing against the sleeping surface. A person's sleeping habit may change the position of the basic form 14. Sometimes it may cover the ear and, on rare occasion, even cover the face about 1" from the ear. Still, the sleeping cap 10 will not press into an individual's face and the face will always stay away at least ⅛" from any surface.

Figure 1A:
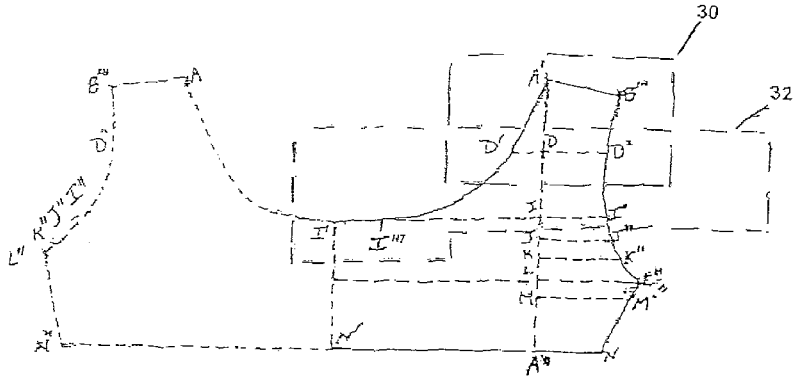
FIG. 1A is a pattern for cutting a fabric and a foam rubber to make a basic form of a sleeping cap according to the invention.
Figure 1B:
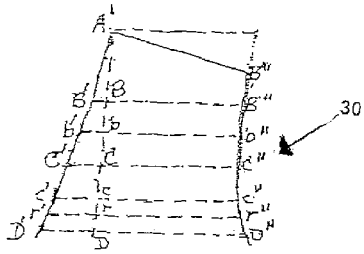
FIG. 1B shows an enlarged view of a first portion of FIG. 1A according to the invention.
Figure 1C:
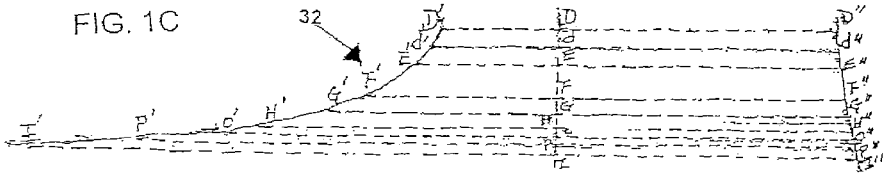
FIG. 1C shows an enlarged view of a second portion of FIG. 1A according to the invention.

Referring now to FIG. 1A, FIG. 1B, and FIG. 1C, FIG. 1 is a pattern for cutting a fabric and a foam rubber to make the basic form 14 of sleeping cap 10 according to the present invention. FIG. 1B shows an enlarged view of a first portion 30 of FIG. 1A, and FIG. 1C shows an enlarged view of a second portion 32 of FIG. 1A. The reference letters in the drawings provide points for measuring distance in inches which are provided for a preferred embodiment as listed in Tables 1 and 2. Table 1 provides distances for reference points in FIGS. 1A, 1B and 1C, and Table 2 provides distances for reference points in FIG. 2C.

One of ordinary skill in the art will recognize that many modifications to the distances for reference points in Tables 1 and 2 may be made to implement various size sleeping caps in accordance with the scope of this invention.

A method of making or constructing the basic form 14 for the sleeping cap 10 comprises the steps of:

(a) obtaining one-half yard of woven cotton or cotton blend broad cloth;

TABLE 1

| | | | |
|---|---|---|---|
| A-A" = 6 5/16" | A-A' = 2⅛" | A'-B"' = ½" | A-B"' = 2⅛" |
| A-B = 1" | A-C = 2" | A-D = 3" | A-I = 4" |
| A-K = 5" | A-M = 6" | B-B' = 3/16" | B-B" = 2 1/32" |
| B-b = ½" | b-b' = 5/16" | b-b" = 1 31/32" | C-C' = 7/16" |
| C-C" = 1 15/16" | C-c = ½" | c-c' = 9/16" | c-c" = 1 15/16" |
| c-r = ¼" | r-r' = ⅝" | r-r" = 1 15/16" | D-D' = ¾" |
| D-D" = 1 31/32" | D-d = ⅛" | d-d' = ⅞" | d-d" = 1 31/32" |

TABLE 1-continued

| | | | |
|---|---|---|---|
| D-E = ⅛" | E-E' = 1" | E-E" = 2" | E-F = ¼" |
| F-F" = 1½" | F-F"' = 2 1/32" | F-G = 3/16" | G-G' = 2 3/16" |
| G-G" = 2 1/16" | G-H = 1/16" | H-H' = 2⅝" | H-H" = 2 3/32" |
| H-O = 1/16" | O-O' = 3" | O-O" = 2 3/32" | O-P = 1/16" |
| P-P' = 3⅝" | P-P" = 2⅛" | P-I"' = ⅜" | I"'-I' = 1/18" |
| I-I' = 4" | I-I" = 25/32" | I-J = ½" | J-J" = 2 5/16" |
| K-K" = 2⅝" | K-L = ⅜" | L-L" = 2⅞" | M-M" = 2 7/16" |
| A"-N = 2¼" | N-N' = 6¼" | N-N"' = 12½" | I"'-N = 2⅜" |

TABLE 2

| | |
|---|---|
| A-A' = B-B' = 3¼" | A-B = A'-B' = 2" |

(b) obtaining a one-inch thick piece of foam rubber of normal density measuring approximately 45 inches by 16 inches;

(c) cutting the foam rubber to the size and shape in accordance with the pattern of FIG. 1A and dimensions in Table 1.

Figure 2C:
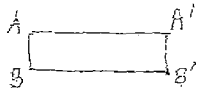
FIG. 2C shows a piece of foam rubber used in the upper extensions of the basic form as shown in FIG. 2B.

(d) cutting two pieces 16, 18 of foam rubber to the size and shape in accordance with the pattern of FIG. 2C and dimensions in Table 2.

(e) cutting two pieces of the cloth to have a size and shape as illustrated in FIG. 2A which is accomplished by adding approximately one inch larger all around to the pattern of FIG. 1A and extending the cloth legs 22, 24 to be approximately seven inches above the ends of the legs 15, 17 of the basic form 14.

(f) sewing the two pieces of cloth from step e together approximately ⅜ inches from the edge but leaving open the inner edge marked 23 in FIG. 2A.

(g) turning inside-out the cloth 16 of step f and inserting foam rubber cut in step 3 through the opening 23 in cloth 26.

(h) Inserting the two pieces 16, 18 of foam rubber into the legs 22, 24 of cloth 26 and positioning the narrow ends of the pieces 16, 18 facing the ends of the legs 15, 17 of the basic form 14.

(i) Sewing the edge opening 23 of the cloth 26 as illustrated in FIG. 2B.

(j) Sewing the ends of the legs 22, 24 of cloth 26 together as illustrated in FIG. 2D and FIG. 2E by folding one end 22 by one-half inch, inserting the other end 24 through the folded end 22, and sewing ends 22 and 24 together to make the basic form 14 with fabric or cloth 26 into a ring shape, as shown in FIG. 3A and FIG. 3B.

Referring to FIG. 3A, the sleeping cap 10 is secured to a person's head by straps 19, 21. The first strap 19 is attached to one side of the sleeping cap 10 and the second strap 21 is attached to the other side. A loop 20 hangs from strap 19 for receiving strap 21, and a buckle 25 is positioned near an end of strap 19 for receiving strap 21. The straps 19, 21 may be embodied by a commonly available smooth satin fabric for ease of sliding through the buckle 25.

Figure 4A:
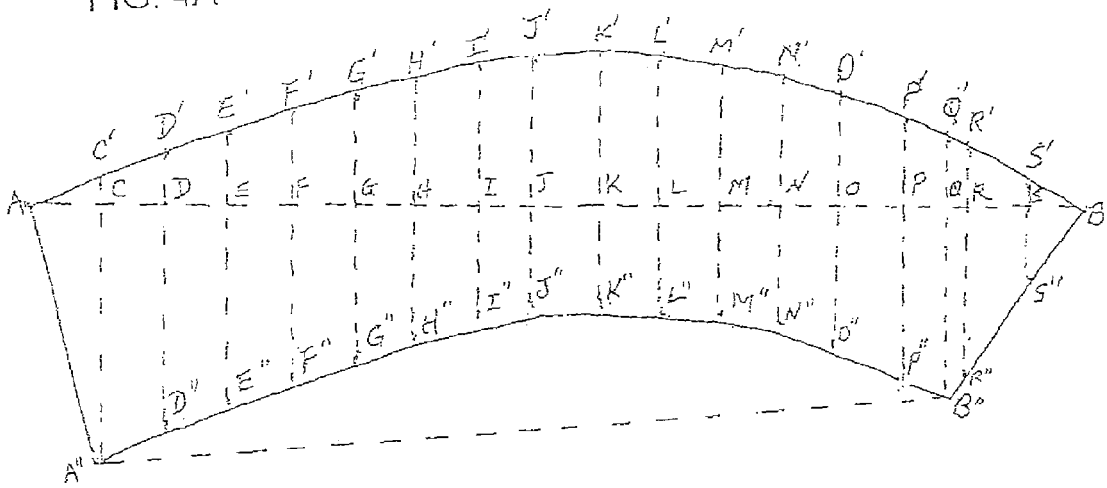
FIG. 4A is a diagram of a pattern for cutting a first section of a cover fabric for the sleeping cap.
Figure 4B:
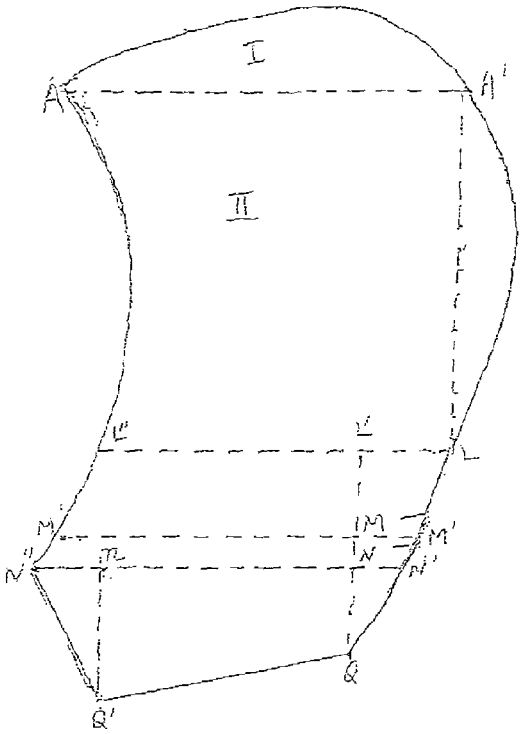
FIG. 4B is a diagram of a pattern for cutting a second section of the cover fabric for the sleeping cap.

Referring to FIG. 4A and FIG. 4B, FIG. 4A is a diagram of a pattern for cutting a first section of a cover fabric, such as commonly known lace material, for the sleeping cap 10, and FIG. 4B is a diagram of a pattern for cutting a second section of the cover fabric for the sleeping cap 10. The first section is matched and sewn to the second section of cover fabric forming a cover for positioning over the top of the ring of the sleeping cap 10.

This invention has been disclosed in terms of a preferred embodiment. It will be apparent that many modifications can be made to the disclosed sleeping cap without departing from the invention. Therefore, it is the intent of the appended claims to cover all such variations and modifications as come within the true spirit and scope of this invention.

Alternate Embodiment

Figure 11A:
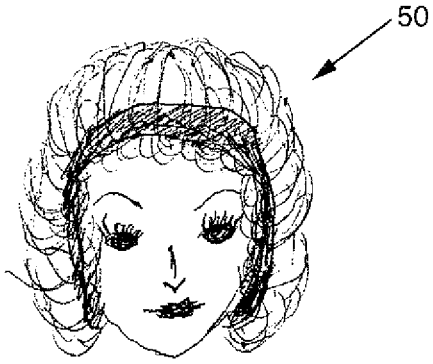
FIG. 11A shows an alternate embodiment according to the present invention showing a front view of a sleeping cap positioned on a person's head.
Figure 11B:
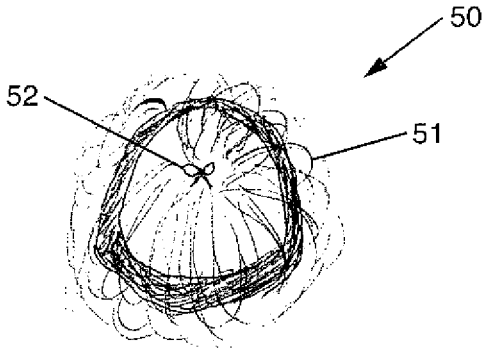
FIG. 11B shows a rear view of the alternate embodiment of FIG. 11A according to the present invention positioned on a person's head.
Figure 12:
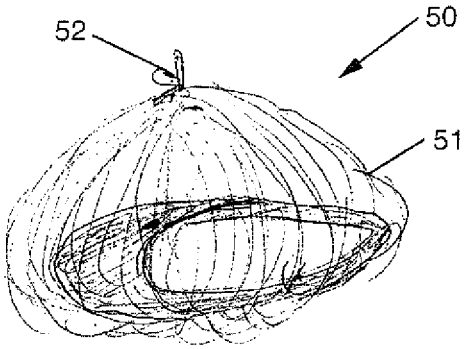
FIG. 12 shows a side view of the alternate embodiment sleeping cap of FIG. 11A and FIG. 11B according to the present invention.

Referring to FIG. 11A, a front view is shown of an alternate embodiment of a sleeping cap 50 positioned on a person's head according to the present invention. FIG. 11B shows a rear view of the sleeping cap 50 and FIG. 12 shows a side view. Sleeping cap 50 does not require a chin strap to secure the sleeping cap to a person's head, and it does not require the use of bobby pins or hair pins to keep it in place on a person's head. Instead, it is a large roomier elastic encased cap which resembles a shower cap and encloses only a one piece basic form 54. A roomier sleeping cap 50 enables use of the sleeping cap on persons with thick hair or having various coiffures or using curlers. The sleeping cap 50 partially covers the ears of the person wearing it, but does not prevent hearing and never covers the face of the wearer. In warm weather simple temporary cooling devices such as cold pads are available for use on the neck of a person under the sleeping cap 50. This temporary relief is enough for a person to fall asleep.

Figure 5:
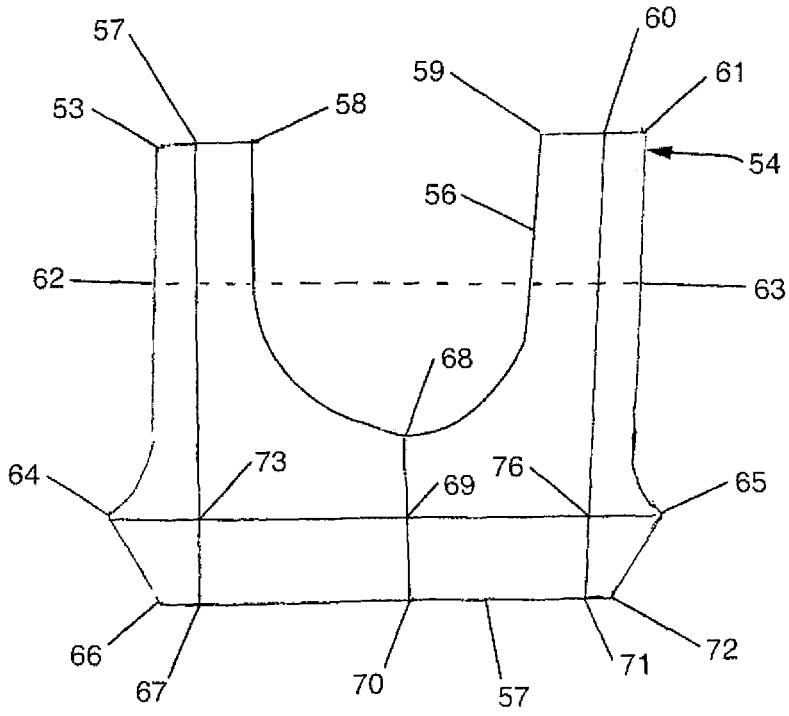
FIG. 5 is a front elevation view of a foam rubber basic form according to the present invention.

Referring to FIG. 5, a front elevation view of the generally U-shaped basic form 54 is shown which is embodied with only one piece of foam rubber approximately one inch thick of a density that is comfortable to lay one's head on, and having two columns 53, 56 extending from a base portion 57. However, any material that is soft and comfortable may be used in place of the foam rubber to embody the basic form 54.

Figure 6A:
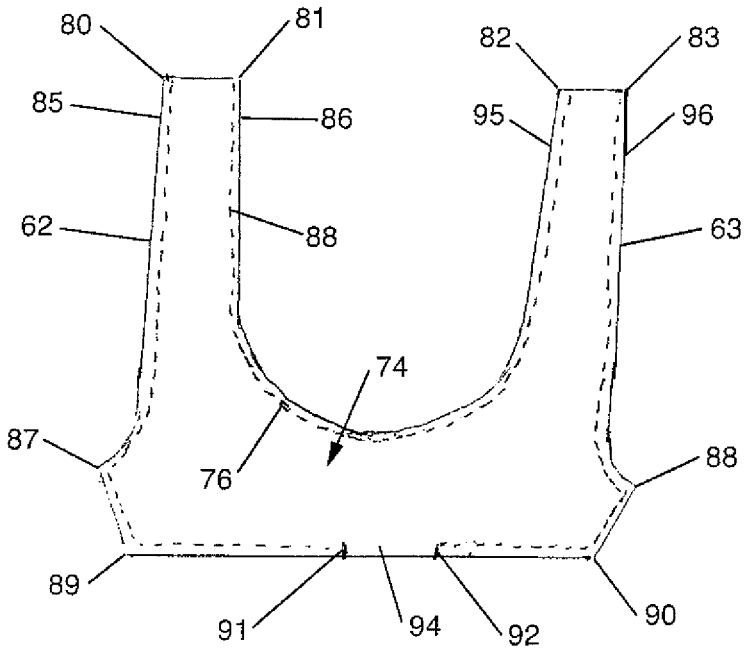
FIG. 6A shows two pieces of fabric cut larger than the shape of the foam rubber basic form of FIG. 5, placed one on top of the other and sewn together.

Referring to FIG. 6A, two pieces of fabric 74, 75 are cut to the shape shown and stitched together as indicated by the dashes 76. However, there is no stitching yet between points 80-81, 82-83 and 91-92. The first piece of fabric 74 is positioned on top in FIG. 6A and the second piece of fabric 75 is positioned under fabric 74 before they are stitched together.

The fabric 74,75 may be embodied by any wrinkle free cotton blend broad cloth, rayon, satin, or any other fancy fabric that is easy to care for and easy to wash and dry. The two pieces of fabric 74,75 are sewn together with the finish (or "right" side) facing each other and then the fabrics 74, 75 are turned inside out so that the finished or "right" side is facing out.

Figure 6B:
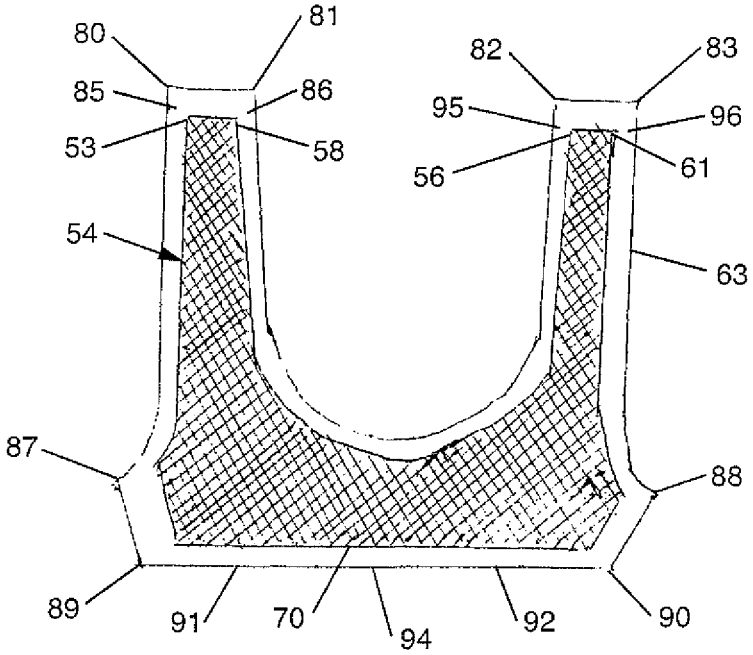
FIG. 6B shows the foam rubber basic form of FIG. 5 placed on top of the two pieces of fabric sewn together except for 3 openings prior to insertion of the foam rubber basic form into a bottom opening.

Referring to FIG. 6B, the foam rubber basic form 54 is shown placed on top of the sewn together fabrics 74, 75 of FIG. 6A showing an overlap of the fabrics 74, 75 which in the preferred embodiment is approximately one inch all around the perimeter of the basic form 54, except the overlap between points 80-85, 81-86, 82-95 and 83-96 is approximately 1½ inches above the upper ends of columns 53, 56 of the basic form 54.

The next step in the method is to insert the basic form within the fabrics 74, 75 between points 91 and 92. If cotton, synthetic fiber fill or any other soft stuffing material is used instead of foam rubber, then the upper ends or legs of the fabrics 74, 75 are sewn together between points 85 and 86 and between points 95 and 96. The filling is then inserted between points 91 and 92. Following the insertion of the material to form the basic form 54, the fabric 74, 75 between points 91 and 92 is sewn together.

Figure 7A:
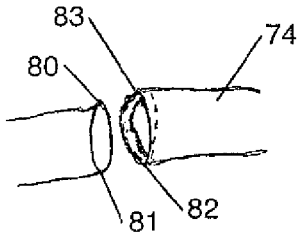
FIG. 7A shows one of the edges of one of the two legs of the outer fabric folded inward.
Figure 7B:
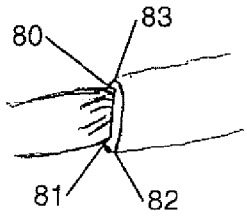
FIG. 7B shows the end of one leg of the outer fabric inserted into the other leg.
Figure 7C:
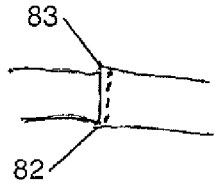
FIG. 7C shows the ends of the legs of the outer fabric inserted one inside the other and sewn together.

Referring now to FIGS. 7A, 7B and 7C, FIG. 7A shows the edge of the outer fabric 74, 75 is folded inward approximately ½ inch to make a clean edge. FIG. 7B shows the fabric between points 80 to 81 of the first leg inserted into the opening of the second leg between points 82 to 83. FIG. 7C shows the end of the first leg inserted into the end of the second leg and, the two legs are sewn together, one inside the other between points 82 to 83.

Figure 8A:
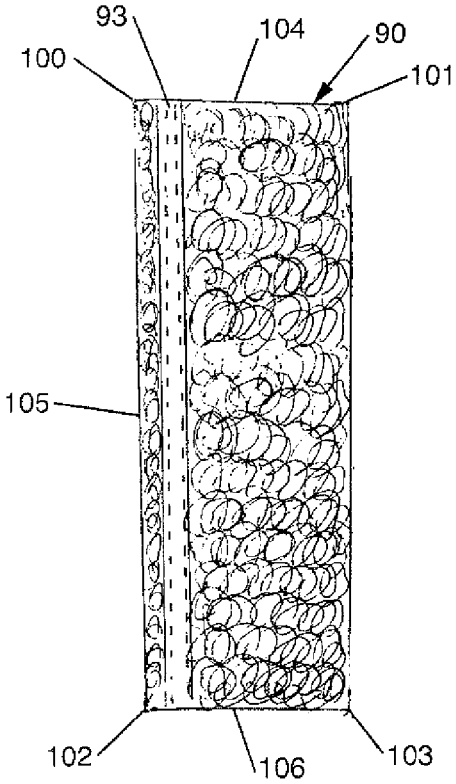
FIG. 8A shows a rectangular section of lace having a wide ribbon attached a predetermined distance from and parallel to a vertical edge.

Referring to FIG. 8A, a rectangular section of lace 90 is shown having a wide ribbon 93 attached a predetermined distance from and parallel to a vertical edge 105 of the rectangular section. In the preferred embodiment the rectangular section is approximately sixteen inches wide and forty-four inches long. Although lace material is used for the rectangular section in the preferred embodiment, other light weight, soft and wrinkle free fabric may be used in place of lace such as a fine tulle. The ribbon 93 is approximately two inches wide and 44 inches long, and it is positioned along the vertical edge 105 and sewn to the lace 90 approximately ⅜ inch away from the vertical edge 105 of the lace 90. The ribbon 93 is provided to enforce or strengthen the lace 90 to withstand subsequent tacking of the basic form 54 to the lace 90.

Figure 8B:
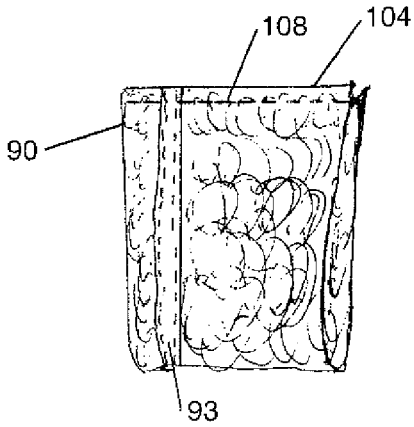
FIG. 8B shows the bottom end sewn to the top end of the rectangular section of lace in FIG. 8A approximately one-half inch from the edges forming a ring with the ribbon side out.
Figure 9:
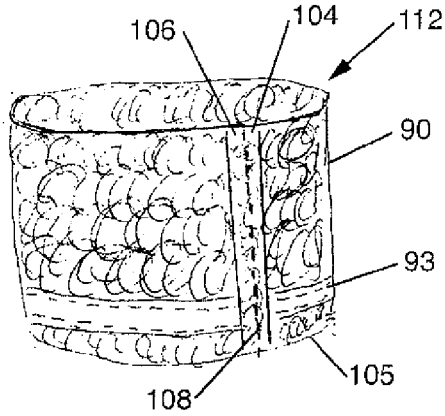
FIG. 9 shows the lace ring of FIG. 8B rotated ninety degrees with the ribbon showing around the outside of the ring.

Referring to FIG. 8B and FIG. 9, FIG. 8B shows the bottom end 106 of the rectangular section of lace 90 folded and sewn to the top end 104 approximately one-half inch away from the edges. FIG. 9 shows the lace 90 of FIG. 8B rotated ninety degrees forming the shape of a ring 112 with the ribbon 93 side out. The sewed together ends 104, 106 are pressed open and flat at the seam 108.

Figure 10A:
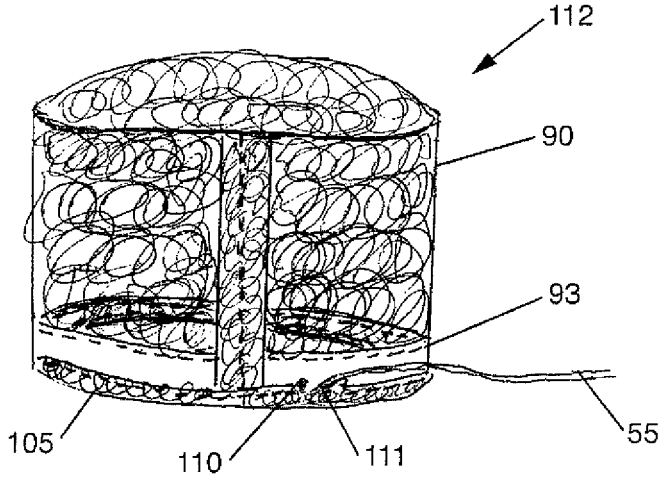
FIG. 10A shows the bottom edge of the ring of FIG. 9 folded back approximately three-eighths inches covering a portion of the ribbon and sewn close to the lace bottom edge and an opening in the lower portion of the ring of FIG. 9 for inserting an elastic.

Referring to FIG. 10A, the bottom edge 105 is folded back approximately ⅜ inch covering approximately ⅜ inch of the ribbon 93 and sewn close to the lace edge except for an opening at points 110 and 111 forming a channel for insertion of an elastic 55.

Figure 10B:
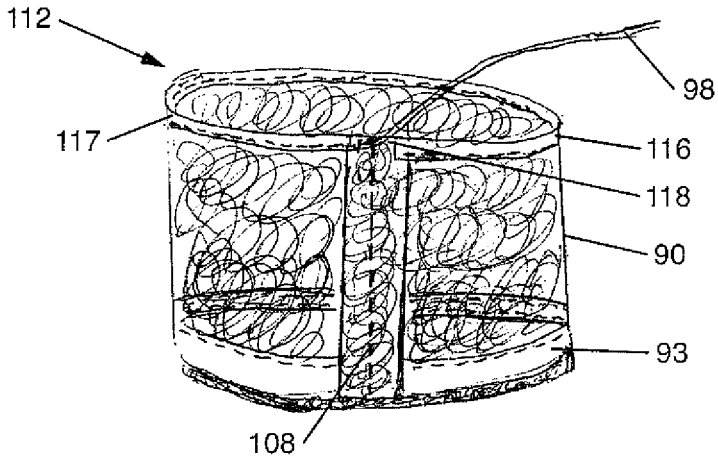
FIG. 10B shows a bias tape of shear material straddling the top edge of the ring and sewn to the ring except for an opening to insert a ribbon for gathering the lace.

Referring to FIG. 10B, a bias tape 116 of sheer material is placed over the top edge 114 of the ring 112 so that it straddles the top edge 114. If fabric other than lace or tulle is used, the bias tape 116 should be made from the same fabric. Two sides of the bias tape and the lace 90 are sewn together (indicated by dash lines 117) close to the bias tape edges leaving an opening 118 to insert a narrow (approximately ⅛ inch) ribbon 98 which is used together the lace and then a bow 52 is tied to form the top of the sleeping cap 50 as shown in FIG. 12. In the preferred embodiment the bias tape 116 is approximately f inch wide (folded width) and forty-four inches long.

Figure 10C:
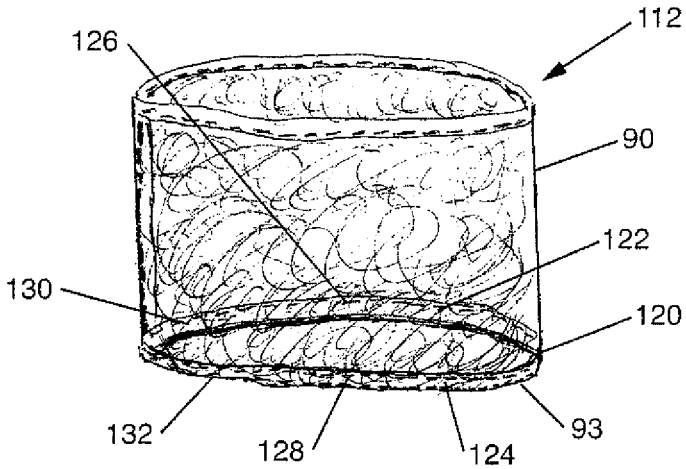
FIG. 10C shows marking points on the inner edge of the ribbon for establishing tacking points when the ring is turned inside out to have the seams inside the ring.

Referring to FIG. 10B and FIG. 10C, FIG. 10C shows marking points on the inner edge of the ribbon 93 for establishing tacking points when the ring 112 is turned inside out to have the seam 108 inside the ring 112. The ring 112 of sewn lace is compressed with the sewn edge 108 on the left side and then the right side at point 120 is marked with a pin or erasable maker at an inner edge of the ribbon 93. From the point 120 in the preferred embodiment, measure nine inches in both directions and mark points 122 and 124 on the ribbon 93; measure six and one-half inches away from points 122 and 124 and mark points 126 and 128; measure five and one-half inches away from points 126 and 128 and mark points 130 and 132 on the ribbon 93.

Still referring to FIG. 10A, FIG. 10B and FIG. 10C, turn the ring 112 inside out so that the seams are now on the inside. Next, an elastic 55 approximately one-quarter inch wide and twenty-two inches long is inserted into the opening between points 110 and 111 as indicated in FIG. 10A and sew the two ends of the elastic 55 to form an elastic ring within the lace ring 112. The sleeping cap 50 with the elastic 55 at the edge enables the basic form 54 to stay within the cap 50. The elastic may be embodied by a Dritz Braided Elastic manufactured by Prym Consumer USA Inc.

Referring to FIG. 10B and FIG. 12, a narrow ribbon 98 approximately one-eighth inch wide and twenty inches long is inserted at opening 118 (FIG. 10B) into the casing formed by the bias tape 116, and both ends of the ribbon 98 are pulled at the opening 118 to form a gathered top 51 of the sleeping cap 50 as shown in FIG. 12. The narrow ribbon 98 is tied into the bow 52 and the long ends cut off at an appropriate length.

The narrow ribbon 98 may be embodied by a ribbon manufactured by C.M. Offray & Son of Chester, N.J.

Referring now to FIG. 6A, FIG. 7A and FIG. 9, point 83 of fabric 74 is matched with the lace seam along lace edge 105 at the inside and tack point 83 on the ribbon 93 and lace 90 close to the elastic edge.

Referring to FIG. 6A, FIG. 6B and FIG. 10C, with fabric 74 facing the lace 90 and ribbon 93, match point 130 (FIG. 10C) with point 85 (FIG. EA) and match point 132 with point 96 and tack the point close to the elastic 55; then match and tack the following points close to the elastic 55: point 126 to point 62, point 128 to point 63, point 124 to point 88 (FIG. 6A), point 122 to point 87, and point 120 to point 94. Tacking the basic form 54 within the sleeping cap 50 makes the basic form 54 stay in position and facilitates the sleeping cap 50 staying on the person throughout the night.

Table 3 lists distances between reference points in FIGS. 5, 6A and 6B for the preferred embodiment, however one of ordinary skill in the art will recognize that many modifications to the distances between reference points in Table 3 may be made to implement various size sleeping caps 50 in accordance with the scope of this invention.

TABLE 3

| |
|---|
| 56-58 = 59-61 = 2" |
| 62-63 = 12" |
| 66-72 = 12½" |
| 64-69 = 65-69 = 6½" |
| 64-65 = 13" |
| 68-69 = 1½" |
| 69-70 = 73-67 = 76-71 = 1½" |
| 57-67 = 60-71 = 11" |
| 66-70 = 72-70 = 6¼" |
| 85-62 = 96-63 = 56-62 = 61-63 = 4½" |
| 80-85 = 81-86 = 82-95 = 83-96 = 1½" |

What is claimed is:

1. A sleeping cap comprising:

a generally U-shaped basic form having a first column and a second column extending from a lower portion having side edges extended outward;

a fabric formed to cover said U-shaped basic form;

said U-shaped basic form inserted within said fabric, wherein a first end of said fabric covers a first column of said basic form and a second end of said fabric covers a second column of said basic form;

said first end of said fabric is inserted within an opening of said second end of said fabric and attached thereto;

a soft, light weight material having two ends sewn together forming a ring shaped material;

an elastic enclosed within a lower perimeter channel of said ring shaped material, said elastic having two ends attached together;

a bias tape is attached to an upper edge of said ring shaped material overlapping each of said side edges;

a ribbon having first and second ends inserted into a casing formed by said bias tape wherein the ends of said ribbon when pulled together form said soft, light weight material into a gathered top portion of said sleeping cap;

a plurality of points around a lower perimeter of said soft, light weight ring-shaped material are attached to said fabric around the edges of said U-shaped basic form forming said sleeping cap.

2. The sleeping cap as recited in claim 1 wherein said U-shaped basic form comprises a cushion-like material including foam rubber.

3. The sleeping cap as recited in claim 1 wherein said fabric comprises one of a group including a wrinkle free cotton blend, rayon, satin and other fancy fabric.

4. The sleeping cap as recited in claim 1 wherein said soft, light weight material comprises one of a group including lace, fine tulle and other soft and wrinkle free fabric.

5. The sleeping cap as recited in claim 1 wherein said ring shaped material comprises a second ribbon around the circumference of said material and attached a predetermined distance from an edge of said ring shaped material.

6. A method of making a sleeping cap comprising the steps of:

providing a generally U-shaped basic form having a first column and a second column extending from a lower portion having side edges extended outward;

forming a fabric to cover said U-shaped basic form;

inserting said U-shaped basic form within said fabric, wherein a first end of said fabric covers a first column of said basic form and a second end of said fabric covers a second column of said basic form;

inserting said first end of said fabric above said first column within an opening of said second end of said fabric above said second column and attaching said first end and said second end together;

forming a ring shaped material from a rectangular, soft, light weight material by sewing two narrow ends together;

enclosing an elastic within a lower perimeter channel of said ring shaped material, said elastic having two ends attached together;

attaching a bias tape to an upper edge of said ring shaped material overlapped on each of said side edges;

inserting a ribbon having first or second end into a casing formed by said bias tape;

pulling and tying the ends of said ribbon together to form said soft, light weight material into a gathered top portion of said sleeping cap;

attaching a plurality of points around a lower perimeter of said soft, light weight ring-shaped material to said fabric around the edges of said U-shaped basic form forming said sleeping cap.

7. The method as recited in claim 6 wherein said step of providing a generally U-shaped basic form comprises the step of providing a cushion-like material including foam rubber.

8. The method as recited in claim 6 wherein said step of forming a fabric to cover said U-shaped basic form comprises the step of providing a fabric from one of a group including a wrinkle free cotton blend, rayon, satin and other fancy fabric.

9. The method as recited in claim 6 wherein said step of forming a ring shape of a rectangular, soft, light weight material comprises the step of providing said material from one of a group including lace, fine tulle and other soft and wrinkle free fabric.

10. The method as recited in claim 6 wherein said method comprises the step of providing a second ribbon around the circumference of said ring shaped material attached a predetermined distance from an edge of said ring shaped material.

* * * * *